US011913216B2

(12) United States Patent
Allen et al.

(10) Patent No.: US 11,913,216 B2
(45) Date of Patent: Feb. 27, 2024

(54) SYSTEMS AND METHODS FOR FABRICATION AND USE OF BRACE DESIGNS FOR BRACED FRAMES

(71) Applicant: DBM GLOBAL INC., Phoenix, AZ (US)

(72) Inventors: Clayton J. Allen, Peoria, AZ (US); Ralph M. Richard, Tucson, AZ (US); Rudolph E. Radau, Jr., Tucson, AZ (US)

(73) Assignee: DBM GLOBAL INC., Phoenix, AZ (US)

( * ) Notice: Subject to any disclaimer, the term of this patent is extended or adjusted under 35 U.S.C. 154(b) by 0 days.

(21) Appl. No.: 18/090,293

(22) Filed: Dec. 28, 2022

(65) Prior Publication Data

US 2023/0203801 A1 Jun. 29, 2023

Related U.S. Application Data

(63) Continuation of application No. 17/117,430, filed on Dec. 10, 2020, now Pat. No. 11,572,685, which is a (Continued)

(51) Int. Cl.
*E04B 1/24* (2006.01)

(52) U.S. Cl.
CPC ..... *E04B 1/2403* (2013.01)

(58) Field of Classification Search
CPC . E04B 1/2403; E04B 1/36; E04B 1/38; E04B 1/54; E04B 1/34; E04B 2001/2415; (Continued)

(56) References Cited

U.S. PATENT DOCUMENTS 5,188,479 A * 2/1993 Nehls ..... F16B 19/1081 403/306
5,735,639 A * 4/1998 Payne ..... B65D 90/0013 588/259

(Continued)

FOREIGN PATENT DOCUMENTS

| | | |
|---|---|---|
| CN | 201695538 | 1/2011 |
| JP | 2002276035 | 9/2002 |
| JP | 2011169042 | 9/2011 |

OTHER PUBLICATIONS

Translation of JP2011169042 (Year: 2011).*

(Continued)

*Primary Examiner* — Jessica L Laux
(74) *Attorney, Agent, or Firm* — SNELL & WILMER L.L.P.

(57) ABSTRACT

Embodiments of the present invention relate to a structural frame member which includes a brace member that is used to absorb energy when the structural frame is subjected to loadings such as seismic, wind and gravity loads. The brace member is coupled to a restraining member that increases the buckling capacity of the brace member so that the brace member has approximately the same load axial capacity in compression as in tension. Embodiments of the invention also relate to the design, construction and assembly of the connection of the brace member that couples the brace member to a gusset plate which is coupled to the beam and column in the structural frame.

17 Claims, 11 Drawing Sheets

Related U.S. Application Data continuation of application No. 16/145,719, filed on Sep. 28, 2018, now Pat. No. 10,876,281, which is a continuation of application No. 15/495,481, filed on Apr. 24, 2017, now abandoned, which is a continuation of application No. 14/822,448, filed on Aug. 10, 2015, now Pat. No. 9,631,357.

(60) Provisional application No. 62/121,123, filed on Feb. 26, 2015.

(58) Field of Classification Search

CPC ..... E04B 2001/2445; E04B 2001/2457; E04B 2001/246; E04B 2001/2466; E04B 2001/2442; E04B 5/43; E04H 9/021; E04H 9/024; E04H 9/027; E04H 9/023; E04H 9/028; E04H 9/02; E04H 9/04; E04H 2009/026; E04C 3/06; E04C 3/32; E04C 3/02; E04C 3/04; E04C 3/36; E04C 3/34; E04C 2003/026; E04C 2003/0486; E04C 2003/0491; E04C 2003/0495

See application file for complete search history.

(56) References Cited

U.S. PATENT DOCUMENTS

| | | | | |
|---|---|---|---|---|
| 6,591,573 | B2 | 7/2003 | Houghton | |
| 7,373,758 | B2 * | 5/2008 | Tsai | E04H 9/0237 52/741.1 |
| 7,707,788 | B2 * | 5/2010 | Bystricky | E04H 9/0237 52/167.3 |
| 7,762,026 | B2 * | 7/2010 | Smelser | E04C 3/02 52/836 |
| 8,763,320 | B1 * | 7/2014 | Chou | E04H 12/16 52/167.3 |
| 9,003,723 | B2 * | 4/2015 | Ueki | E04H 9/0237 52/843 |
| 9,016,007 | B2 | 4/2015 | Marinovic et al. | |
| 9,353,525 | B1 * | 5/2016 | Richard | E04C 3/02 |
| 9,593,505 | B2 * | 3/2017 | Pryor | E04B 1/24 |
| 9,631,357 | B2 | 4/2017 | Allen et al. | |
| 9,856,640 | B2 * | 1/2018 | Shuhaibar | E04H 9/0237 |
| 9,915,078 | B2 * | 3/2018 | Gray | E04B 1/2403 |
| 10,450,748 | B2 * | 10/2019 | Reaveley | E04C 3/32 |
| 10,544,577 | B2 * | 1/2020 | McManus | H01H 85/08 |
| 2003/0222188 | A1 * | 12/2003 | Smelser | E04H 9/0237 248/188.91 |
| 2006/0101733 | A1 | 5/2006 | Jen et al. | |
| 2006/0253057 | A1 * | 11/2006 | Qi | E04C 3/04 602/23 |
| 2011/0252743 | A1 * | 10/2011 | Yang | E04B 1/2403 52/849 |
| 2012/0000147 | A1 | 1/2012 | Chou et al. | |
| 2013/0074440 | A1 * | 3/2013 | Black | E04H 9/0237 52/704 |
| 2013/0139452 | A1 * | 6/2013 | Tsai | E04B 1/98 52/655.1 |
| 2013/0152490 | A1 * | 6/2013 | Hinchman | E04H 9/0215 29/897.3 |
| 2014/0059950 | A1 * | 3/2014 | Marinovic | E04H 9/024 52/167.3 |
| 2015/0000228 | A1 * | 1/2015 | Dusicka | E04C 3/29 52/835 |
| 2015/0197954 | A1 | 7/2015 | Marinovic et al. | |
| 2015/0218838 | A1 | 8/2015 | Ichikawa et al. | |
| 2015/0284971 | A1 * | 10/2015 | Ichikawa | F16F 15/022 267/140.13 |
| 2016/0237711 | A1 * | 8/2016 | Powell | E04H 9/027 |
| 2016/0265217 | A1 * | 9/2016 | Hayes | E04B 1/1903 |
| 2017/0218616 | A1 * | 8/2017 | Richards | E04H 9/024 |
| 2018/0195306 | A1 * | 7/2018 | Wiles | E04C 3/29 |

OTHER PUBLICATIONS

Non-Final Office Action from U.S. Appl. No. 14/822,448, dated Jan. 11, 2016.

Final Office Action from U.S. Appl. No. 14/822,448, dated Nov. 3, 2016.

Notice of Allowance from U.S. Appl. No. 14/822,448, dated Mar. 7, 2017.

Non-Final Office Action from U.S. Appl. No. 15/495,481, dated Mar. 29, 2018.

Restriction Requirement from U.S. Appl. No. 16/145,719, dated Dec. 27, 2019.

Non-Final Office Action from U.S. Appl. No. 16/145,719, dated Mar. 19, 2020.

Examiner Interview Summary from U.S. Appl. No. 16/145,719, dated Jun. 12, 2020.

Notice of Allowance from U.S. Appl. No. 16/145,719, dated Sep. 16, 2020.

Notice of Third Party Submission from U.S. Appl. No. 17/117,430, dated May 18, 2021.

Restriction Requirement from U.S. Appl. No. 17/117,430, dated Mar. 23, 2022.

Non-Final Office Action from U.S. Appl. No. 17/117,430, dated Jul. 6, 2022.

Examiner Interview Summary from U.S. Appl. No. 17/117,430, dated Sep. 15, 2022.

Notice of Allowance from U.S. Appl. No. 17/117,430, dated Nov. 22, 2022.

Tremblay, Seismic Testing and Performance of Buckling-Restrained Bracing Systems, Can. J. Civ. Eng. 33, pp. 183-198 (2006).

Eryasar, An Experimental Study on Steel-Encased Buckling-Restrained Brace Hysteretic Dampers, Earthquake Engng Struct. Dyn. 2010; vol. 39, pp. 561-581 (Sep. 18, 2009).

Eryasar Thesis, Experimental and Numerical Investigation of Buckling Restrained Braces (Feb. 2009).

Tsai, Huge Scale Tests of All-Steel Multi-Curve Buckling Restrained Braces, 15 WCEE Lisboa 2012.

* cited by examiner

2x6x160 Bar (40 ksi), 1x1x0.05 Honeycomb (50 ksi), 0.1 Facesheet, 0.1 Gap

SYSTEMS AND METHODS FOR FABRICATION AND USE OF BRACE DESIGNS FOR BRACED FRAMES

CROSS-REFERENCE TO RELATED APPLICATIONS

This application is a continuation of and claims priority to U.S. patent application Ser. No. 17/117,430, entitled "SYSTEMS AND METHODS FOR FABRICATION AND USE OF BRACE DESIGNS FOR BRACED FRAMES," which was filed on Dec. 10, 2020. The '430 application is a continuation application of and claims priority to U.S. patent application Ser. No. 16/145,719, entitled "SYSTEMS AND METHODS FOR FABRICATION AND USE OF BRACE DESIGNS FOR BRACED FRAMES," which was filed on Sep. 28, 2018, now U.S. Pat. No. 10,876,281, issued Dec. 29, 2020. The '719 application is a continuation application of and claims priority to U.S. patent application Ser. No. 15/495,481, entitled "SYSTEMS AND METHODS FOR FABRICATION AND USE OF BRACE DESIGNS FOR BRACED FRAMES," which was filed Apr. 24, 2017. The '481 application is a continuation application of and claims priority to U.S. patent application Ser. No. 14/822,448, entitled "SYSTEMS AND METHODS FOR FABRICATION AND USE OF BRACE DESIGNS FOR BRACED FRAMES," which was filed on Aug. 10, 2015, now U.S. Pat. No. 9,631,357, issued Apr. 25, 2017. The '448 application claims the benefit of Provisional U.S. Patent Application No. 62/121,123, entitled "BUCKLING RESTRAINED BRACE DESIGNS," filed Feb. 26, 2015. The entire aforementioned disclosures of which are hereby incorporated by reference, for all purposes, as if fully set forth herein.

BACKGROUND OF THE INVENTION

The present invention relates to the design of structural braces in braced frame structures that provides for an improvement of the brace load carrying capacity in structural braced frames. Existing braces may be potentially improved by reducing the weight, the fabrication costs and time, and the strength of thereof. Embodiments of the invention provide solutions to these and other problems.

BRIEF DESCRIPTION OF THE INVENTION

In one embodiment, a structural brace member is provided. The structural brace member may include a tubular element and a core element. The tubular element may have a rectangular cross section. The core element may be disposed within the tubular element, and no substantial material may be disposed within the tubular element between the tubular element and the core element.

In another embodiment, a method of constructing a structure is provided. The method may include coupling a structural brace member with a first gusset plate. The structural brace member may include a tubular element having a rectangular cross section, and a core element disposed within the tubular element, where no substantial material may be disposed within the tubular element between the tubular element and the core element. The first gusset plate may be coupled with a column and/or beam of the structure. The method may also include coupling the structural brace member with a second gusset plate, where the second gusset plate is coupled with another column and/or beam of the structure.

BRIEF DESCRIPTION OF THE DRAWINGS

Embodiments of the present invention are described in conjunction with the following appended figures.

DETAILED DESCRIPTION OF THE DRAWINGS

Figure 1:
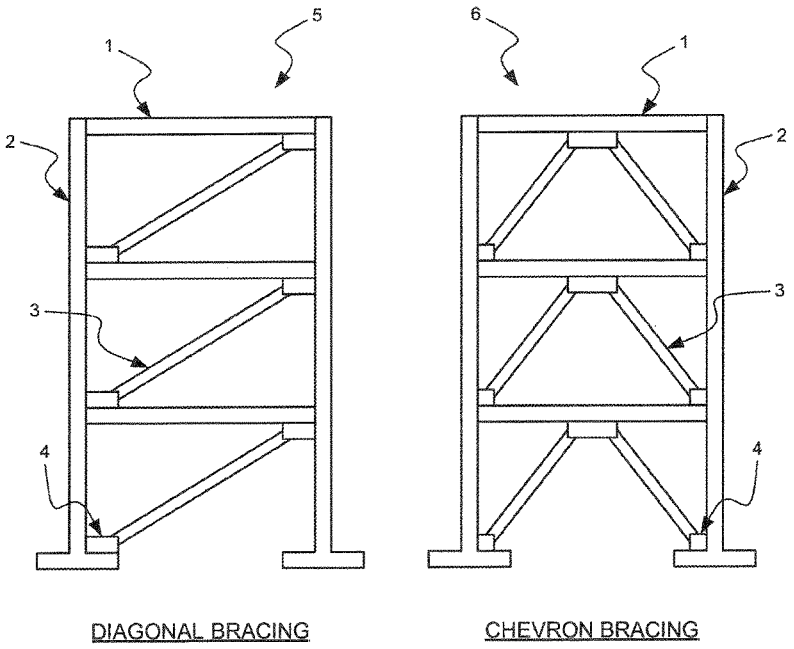
PRIOR ART Fig. 1
FIG. 1 shows typical brace frames comprising beams and columns with diagonal and inverted V bracing configurations.

The ensuing description provides exemplary embodiments only, and is not intended to limit the scope, applicability or configuration of the disclosure. Rather, the ensuing description of the exemplary embodiments will provide those skilled in the art with an enabling description for implementing one or more exemplary embodiments. It is being understood that various changes may be made in the function and arrangement of elements without departing from the spirit and scope of the invention as set forth in the appended claims.

Specific details are given in the following description to provide a thorough understanding of the embodiments. However, it will be understood by one of ordinary skill in the art that the embodiments may be practiced without these specific details. For example, any detail discussed with regard to one embodiment may or may not be present in every version of that embodiment, or in any version of another embodiment discussed herein. In other instances herein, well-known processes, methods, techniques, devices, structures, and tools may be used to implement the described embodiments. Additionally, any time "steel" is recited herein, one of ordinary skill in the art will understand that other metals or materials may also be used.

Braces are used in braced frames that support lateral and gravity loads in buildings, and are typically made of members comprising rolled or cast steel structural steel shapes. Bolted and/or welded gusset plates are used to connect the beams, columns, and braces of the braced frame. Embodiments of the invention reduce the weight, costs, and fabrication time necessary to provide and install braces in a braced frame over that of conventionally designed structural braces.

Methods of design and construction of the bracing members in braced frames are discussed herein which enhance and provide for high resistance and ductile behavior of the frames when subjected to gravity, seismic, and wind loading. More specifically, embodiments of the present invention relates to the design and construction of lightweight braces and their connections that use gusset plates to join the beams and columns to the lateral load carrying brace members with particular use, but not necessarily exclusive use, in framed buildings, in new construction, and in the modification of existing structures.

Embodiments of the present invention relates to how the aforementioned braces are assembled, the means by which the braces are restrained from buckling within the confining tube or box like member, and how brace loads are transferred to frame gusset plates.

The arrangement of the beams, also known as girders, columns, and braces and their connections are designed to ensure the framework can support the gravity and seismic and wind lateral loads contemplated for the intended use of the bridge, building or other structures. Making appropriate engineering assessments of loads and how these loads are resisted represents current design methodology. These assessments are compounded in complexity when considering loads for wind and seismic events, which requires determining the forces, stresses, and strains in the structural members. It is well known that during an earthquake, the dynamic horizontal and vertical inertia loads and stresses and strains imposed on a building have the greatest impact on the braces primarily but may also damage the beams and columns which constitute the resistant frame. Under high seismic or wind loading or from repeated exposure to milder loadings of this kind, these members may fail, possibly resulting in the collapse of the structure and the loss of life.

Turning now to FIG. 1, a possible construction of modern structures such as buildings and bridges is shown, braced frames include beams 1, columns 2, and braces 3 arranged, fastened, or joined together using gusset plates 4, to form a skeletal load resisting framework of a structure. The two bracing systems shown in FIG. 1 are diagonal 5 and chevron 6 systems.

Figure 2:
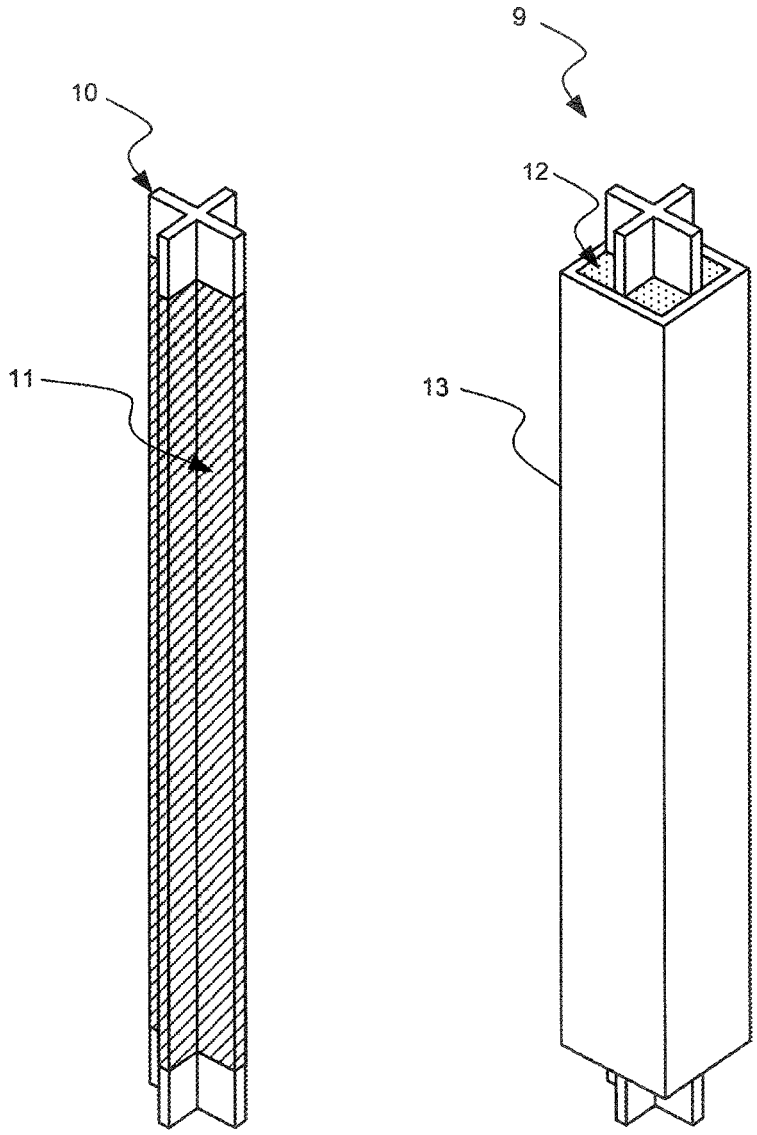
PRIOR ART Fig. 2
FIG. 2 shows a buckling restrained brace design concept that uses mortar and a tube component to provide buckling restraint for a brace.

FIG. 2 shows a typical buckling restrained brace 9 comprising a yielding steel core 10 coated with an un-bounding material 11 that separates the axial load in the steel core from a mortar 12 filled rectangular tube 13. Mortar 12 filled tube 13 is designed to provide only lateral stability to steel core 10 which inhibits brace 9 from buckling when steel core 10 is subjected to a compressive axial load. An embodiment of the invention eliminates mortar 12 of buckling restrained brace 9 which also eliminates the need for un-bonding material 11 between the mortar 12 and steel core 10. Such an embodiment reduces the weight, cost, and fabrication time of the buckling resistant brace.

Figure 3A:
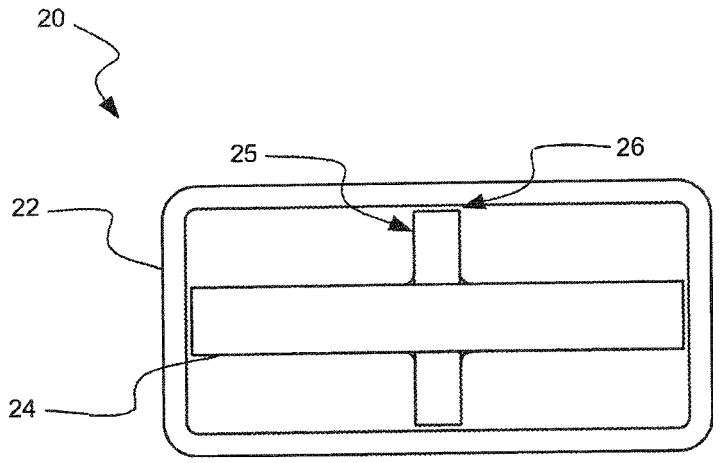
FIGS. 3A and 3B show two separate cross sections of the embodiment of the invention comprising a brace with a horizontal component with single vertical component (cruciform) and a brace with a horizontal component with double vertical components (double cruciform)
Figure 3B:
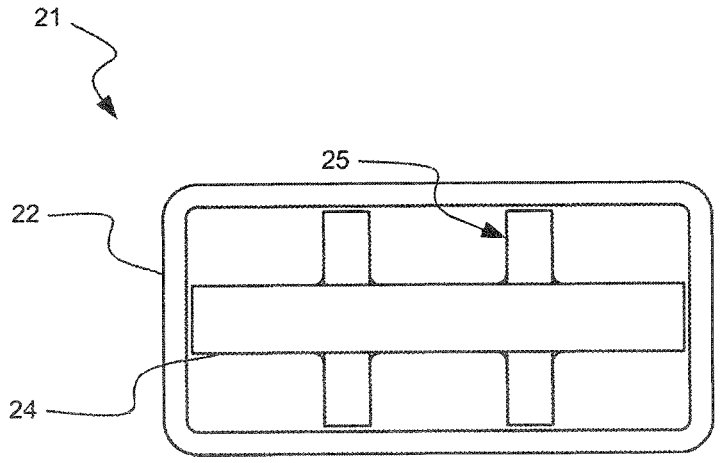

FIGS. 3A and 3B show two cross section designs 20, 21 of such a buckling restrained brace with a steel core (also referred to herein as a "core element") embedded in a rectangular tube 22 (also referred to herein as a "tubular element"). The first brace design 20 includes a horizontal plate 24 with two vertical plates 25 that are coupled to horizontal plate 24 (via welding, some other attachment means, and/or the like) to form a cruciform. The second brace design 21 includes a horizontal plate 24 and four vertical plates 25 (via welding, some other attachment means, and/or the like) to form a double cruciform. In other embodiments, more vertical plates would be possible, such that a triple, quadruple, or greater cruciform cross section could be present.

Both of these designs have the steel core embedded in a rectangular tube 24 with minimum fabrication clearances 26 between the brace components of the steel core and the tube sufficient to allow assembly of the brace. Such fabrication clearances may be between about 0.10 and about 0.25 inches in width. These assembly designs eliminate the need for any restraining material between the steel core and the restraining tube, as shown in FIG. 2. The restraining tube 22, which resists only lateral loads generated by the flexural forces of the steel core, is designed to have sufficient strength and stiffness to inhibit overall lateral buckling of the tube and steel core, when the steel core is subjected to a compressive axial load.

Essentially then, no substantial material is present between the core element and the tubular element in embodiments of the invention. While some embodiments may have an occasional fastening mechanism coupling the core element with the tubular element, as will be discussed below, such fastening mechanisms will occur at singular point-locations. No substantial material present between the core element and the tubular element means that a mortar or other significant material is not present along the length of the combined brace element.

Figure 4:
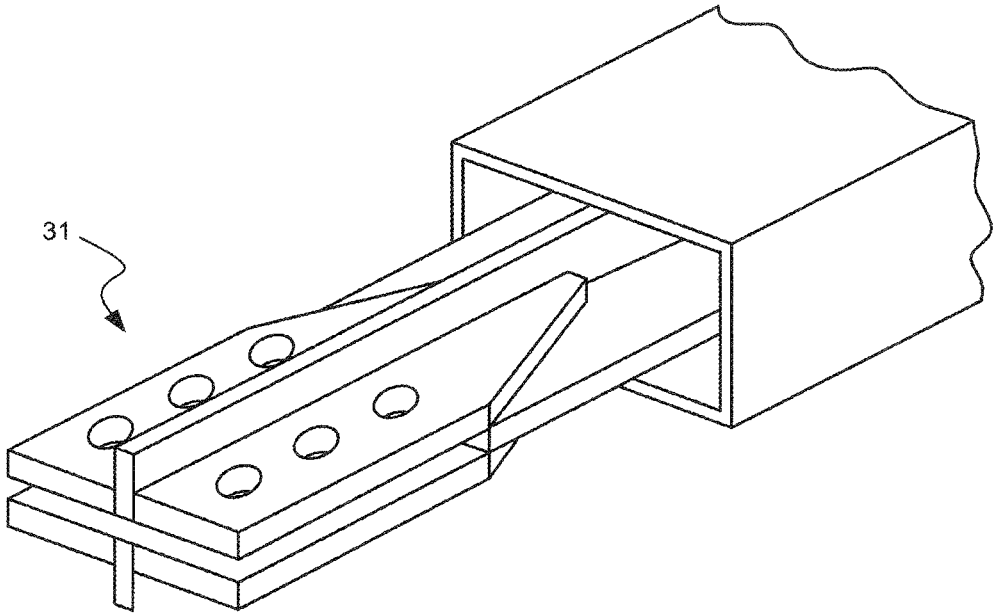
FIG. 4 shows an isometric view of one end of the brace with a horizontal component with a single vertical component and the end connection for attachment to a gusset plate.

Shown to FIG. 4 is an isometric drawing of one end of a buckling restrained brace 20 with the brace-to-gusset end connection 31 including connecting plates. The width and height of the connection of the steel core to the gusset plate is designed to have the maximum width and height of the steel core. This embodiment allows the steel core and connection to be fabricated and assembled independent of the constraining tube or box like structure.

Figure 5:
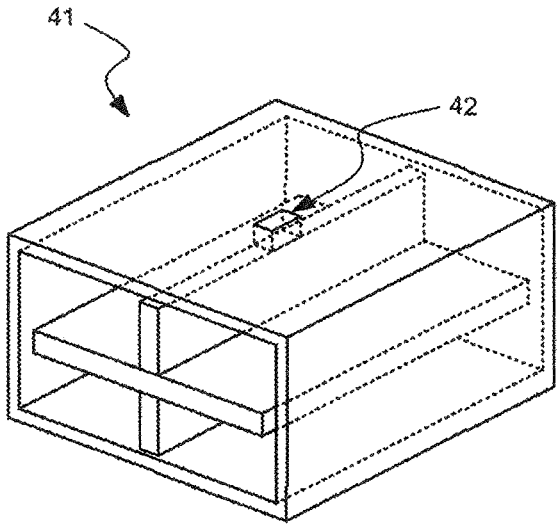
FIG. 5 shows an isometric view of one middle portion of a brace having a fastening mechanism to couple the tubular element with the core element.

Shown in FIG. 5 is an isometric drawing of a central portion 41 of a buckling resistant brace assembly. In this embodiment, the steel core is secured to the restraining tube by fastener 42 or plug weld at the midpoint of the assembly. Various weld types could also be used to secure the steel core to the restraining tube in other embodiments. Note that such a fastener, e.g., a plug weld, etc. is not intended to carry structural loads, but rather keep the core element coupled with the tubular element during assembly and coupling operations.

Figure 6:
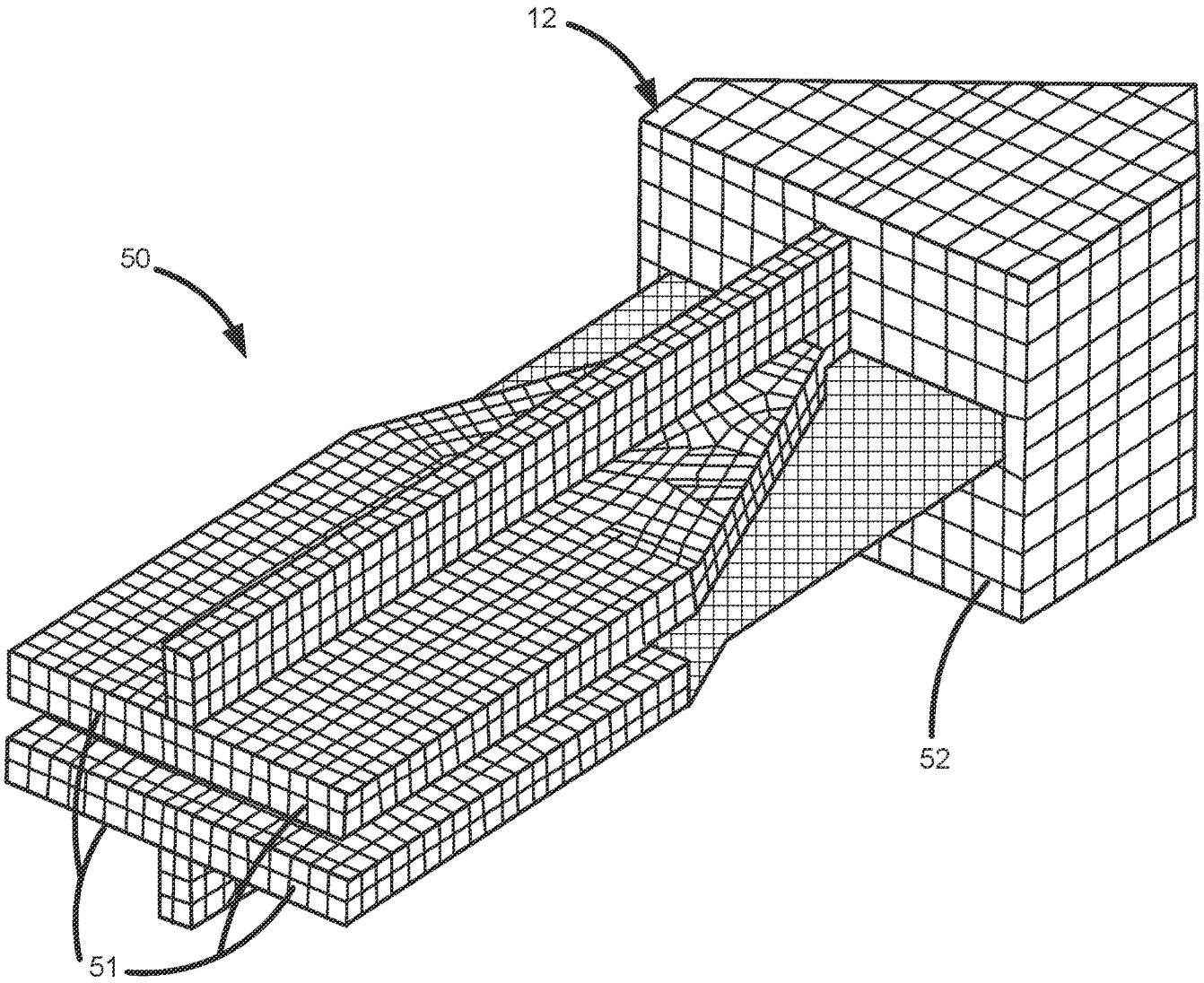
FIG. 6 shows a finite element model view of the brace-to-gusset connection.

Shown in FIG. 6 is a more detailed finite element model of the gusset plate connection assembly 50. This assembly comprises four connection plates 51 and a tube end plate 52. The connecting plates are coupled to the steel core and provide the transfer of the axial load in the steel core to the gusset plate.

Figure 7:
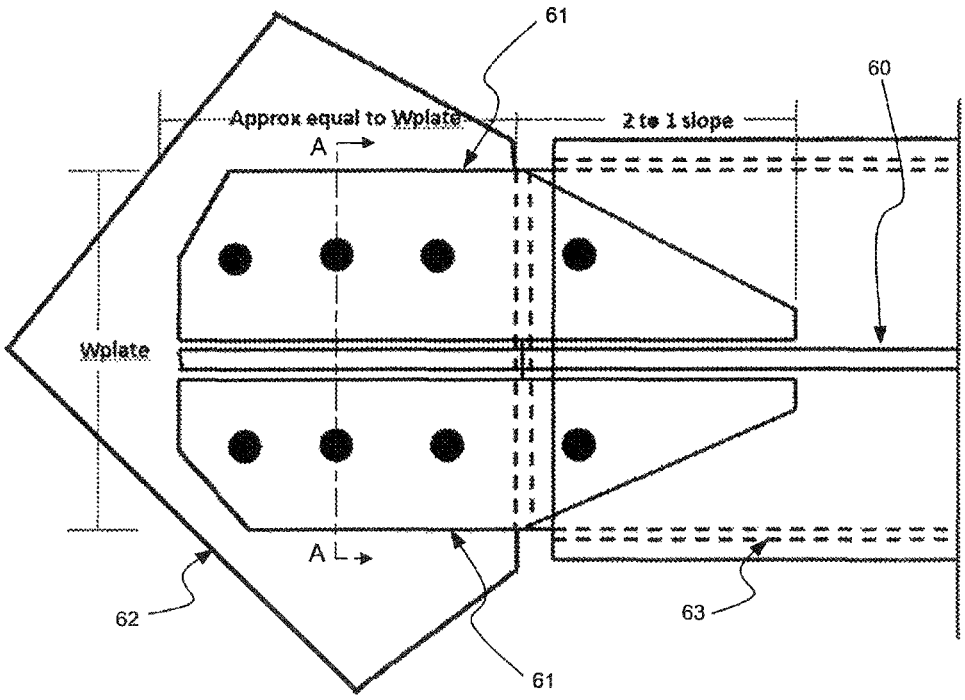
FIG. 7 is a detailed drawing of the bolted-welded gusset plate connection assembly.

FIG. 7 is a detailed drawing of the bolted-welded gusset plate connection assembly showing how the steel core 60 load is transferred by the bolted-welded connection plates 61 to the gusset plate 62. The width of the connecting plates 61 is equal to the width of the steel core 63 to accommodate the complete subassembly of the steel core and connection plates prior to placing this subassembly in the restraining tube according to an embodiment of the invention.

Figure 8:
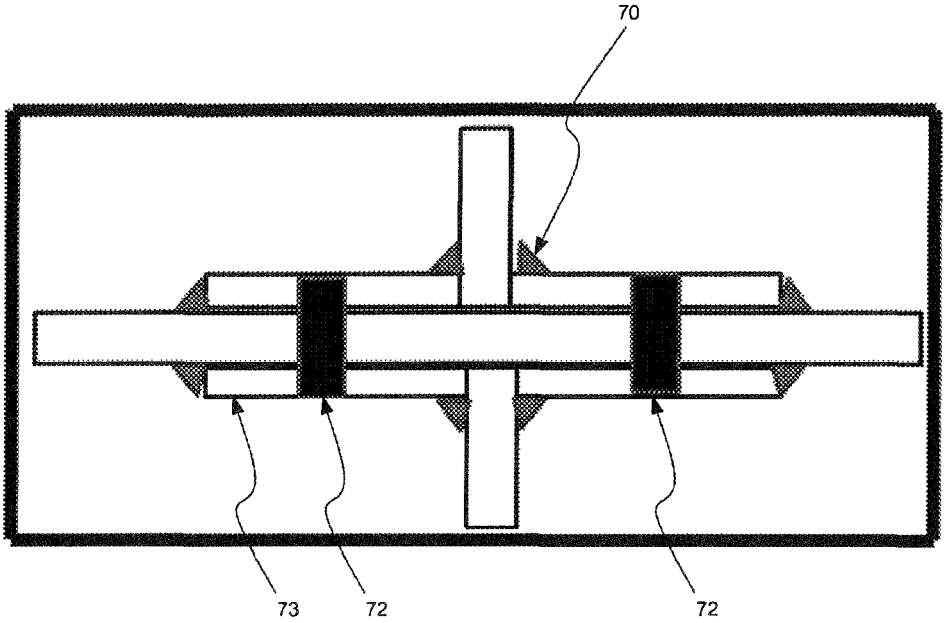
FIG. 8 shows the cross section A-A of FIG. 7 for the bolted-welded connection.

Shown in FIG. 8 is the cross section A-A of FIG. 7. This embodiment of the invention uses both fillet welds 70 and bolts 72 to transfer the steel brace load to the connecting plates 73.

Figure 9:
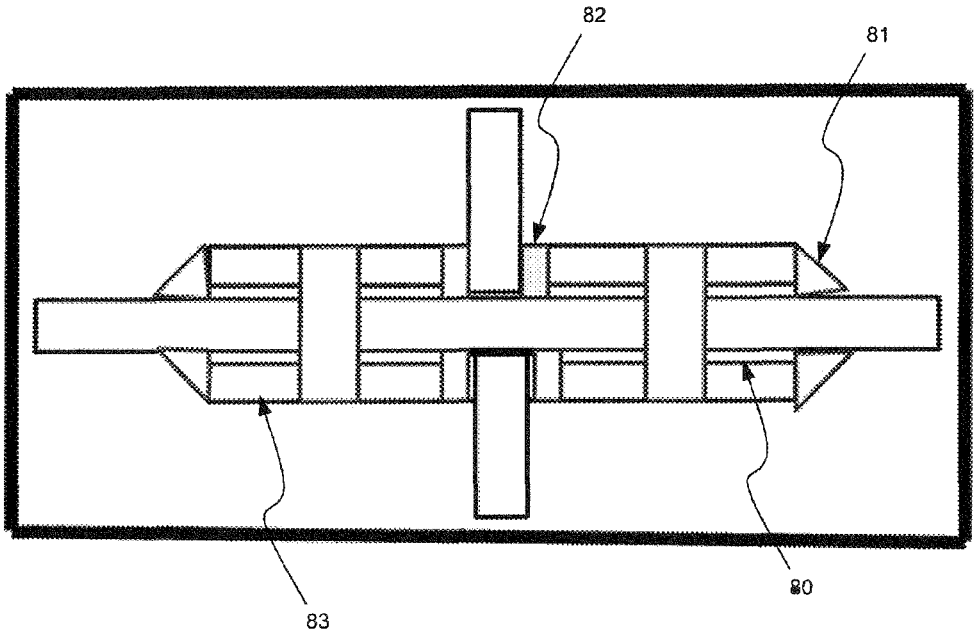
FIG. 9 shows a cross section A-A of FIG. 7 for a bolted-welded connection with plates.

Shown in FIG. 9 is the cross section A-A of FIG. 7 without the bolts. This embodiment of the invention uses shim plates 80 and uses both fillet welds 81 and groove welds 82 to transfer the brace load to the connecting plates 83.

Figure 10:
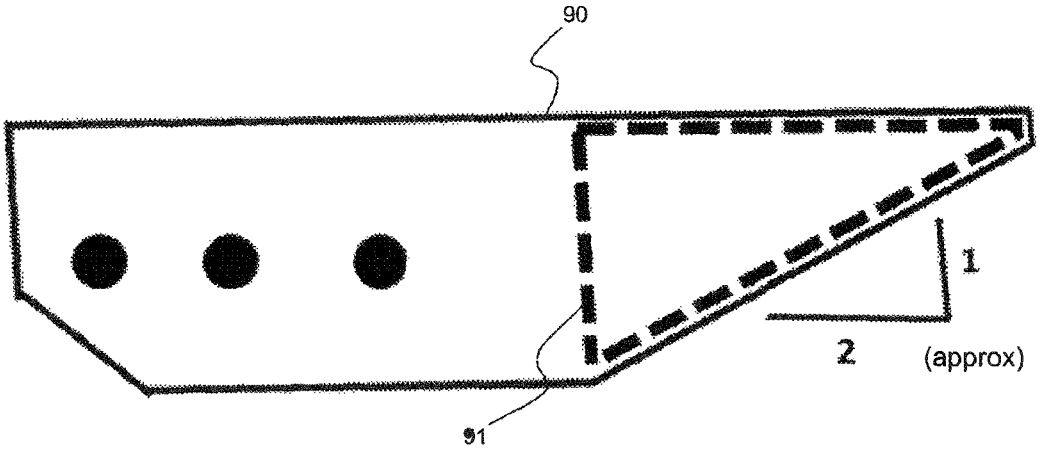
FIG. 10 shows the connecting plates and shim shapes of the connection.

Shown in FIG. 10 are the connecting plate shapes 90 and shim plates 91 location and shape if shims are required.

Figure 11:
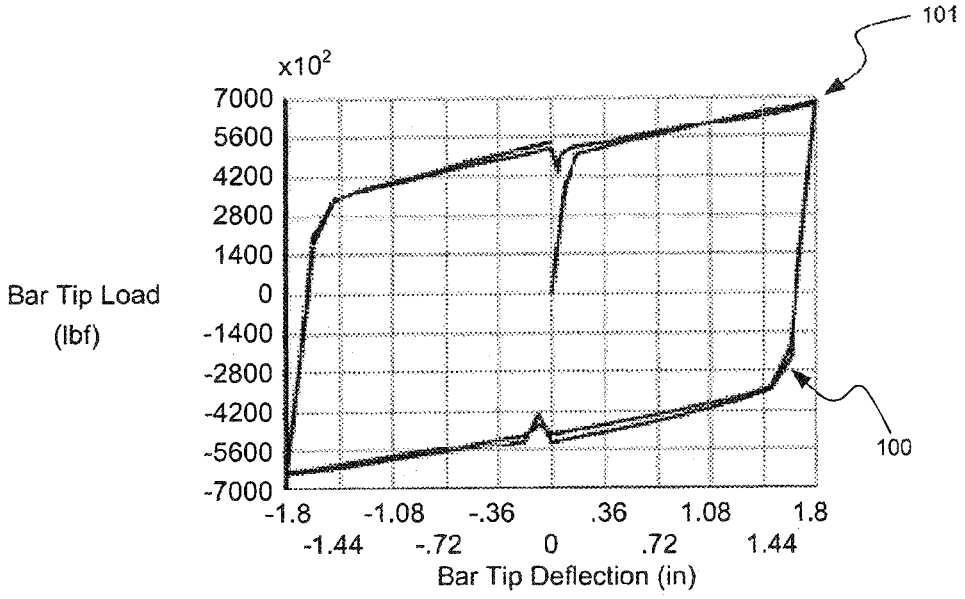
FIG. 11 shows a computer generated hysteresis loop for a buckling restrained brace design in one embodiment of the invention.

In FIG. 11 are computer generated hysteresis loops 100 for a restrained brace assembly having the embodiments of the invention which demonstrate the maximum and minimum brace forces when the assembly brace is subjected to both axial load and alternate lateral drifts of 2.7%. The maximum axial compressive brace load 102 and the maximum axial tensile load 101 are essentially equal according to an embodiment of this invention.

The invention has now been described in detail for the purposes of clarity and understanding. However, it will be appreciated that certain changes and modifications may be practiced within the scope of the appended claims.

What is claimed is:

1. A structural brace member comprising:

a tubular element extending from a first end to a second end and defining a longitudinal direction;

a plate having a top surface and a bottom surface, the plate extending in the longitudinal direction within the tubular element, wherein no substantial material is disposed within the tubular element between the tubular element and the respective top and bottom surfaces of the plate;

a first upper fin extending from the top surface of the plate toward a first interior surface of the tubular element, the first upper fin extending in the longitudinal direction within the tubular element; and a first lower fin extending from the bottom surface of the plate toward a second interior surface of the tubular element, the first lower fin extending in the longitudinal direction within the tubular element;

wherein at least one of the first upper fin and the first lower fin are welded to the tubular element only at a mid-point in the longitudinal direction between the first end and the second end of the tubular element, and wherein the first upper fin and the first lower fin extend from beyond the first end of the tubular element through the tubular element to beyond the second end of the tubular element.

2. The structural brace member of claim 1, wherein the first lower fin and the first upper fin are each secured to the tubular element.

3. The structural brace member of claim 1, wherein:

the first upper fin extends orthogonally from the top surface of the plate, and the first lower fin extends orthogonally from the bottom surface of the plate.

4. The structural brace member of claim 1, wherein:

the plate, the first upper fin, and the first lower fin define a cross-sectional shape; and the cross-sectional shape is constant in the longitudinal direction from the first end to the second end of the tubular element.

5. The structural brace member of claim 1, further comprising a pair of top connecting plates, one of the pair of top connecting plates coupled to the top surface of the plate at a first end of the plate, and one of the pair of top connecting plates coupled to the top surface of the plate at a second end of the plate.

6. The structural brace member of claim 5, wherein a portion of each of the pair of top connecting plates is disposed within the tubular element.

7. The structural brace member of claim 5, further comprising a pair of bottom connecting plates coupled to the bottom surface of the plate at the first end of the plate, and one of the pair of bottom connecting plates coupled to the bottom surface of the plate at the second end of the plate.

8. The structural brace member of claim 1, wherein a height of the first upper fin is the same as a height of the first lower fin.

9. The structural brace member of claim 1, wherein the plate is substantially parallel to a horizontal side of the tubular element, and at least one of the first upper fin and the first lower fin are substantially parallel to a vertical side of the tubular element.

10. The structural brace member of claim 1, wherein the tubular element is a rectangular tube.

11. The structural brace member of claim 1, wherein the tubular element is steel.

12. The structural brace member of claim 1, further comprising a second upper fin and a second lower fin, wherein:

the second upper fin is spaced apart laterally from the first upper fin, and the second lower fin is spaced apart laterally from the first lower fin.

13. The structural brace member of claim 12, wherein:

the first upper fin extends from the top surface of the plate towards the first interior surface of the tubular element, and the first lower fin extends from the bottom surface of the plate towards the second interior surface of the tubular element.

14. The structural brace member of claim 12, wherein:

the first upper fin extends in the longitudinal direction within the tubular element, and the first lower fin extends in the longitudinal direction within the tubular element.

15. The structural brace member of claim 12, wherein:

the plate, the first upper fin, the first lower fin, the second upper fin, and the second lower fin define a cross-sectional shape; and the cross-sectional shape is constant in the longitudinal direction from the first end to the second end of the tubular element.

16. The structural brace member of claim 15, wherein the second upper fin, and the second lower fin are each coupled locally to the tubular element.

17. A structure comprising a bracing system with a plurality of the structural brace member of claim 1.

* * * * *